US006546701B2

(12) United States Patent
Weder et al.

(10) Patent No.: US 6,546,701 B2
(45) **Date of Patent: *Apr. 15, 2003**

(54) PACKAGE AND METHOD OF PACKAGING

(75) Inventors: Donald E. Weder, Highland, IL (US); Frank Craig, Valley Park, MO (US)

(73) Assignee: Southpac Trust International, Inc.

( * ) Notice: Subject to any disclaimer, the term of this patent is extended or adjusted under 35 U.S.C. 154(b) by 58 days.

This patent is subject to a terminal disclaimer.

(21) Appl. No.: 09/837,475

(22) Filed: Apr. 18, 2001

(65) Prior Publication Data

US 2002/0002811 A1 Jan. 10, 2002

Related U.S. Application Data

(63) Continuation-in-part of application No. 09/723,933, filed on Nov. 28, 2000, which is a continuation of application No. 09/289,506, filed on Apr. 9, 1999, now Pat. No. 6,189,297, which is a continuation of application No. 08/899,249, filed on Jul. 23, 1997, now Pat. No. 5,910,089.

(51) Int. Cl.[7] ..... B65B 55/20

(52) U.S. Cl. ..... 53/474; 53/472; 53/113; 53/390; 206/584; 493/464; 493/967

(58) Field of Search ..... 53/390, 472, 474, 53/121, 461, 113, 115, 238, 445; 206/584, 591, 521, 521.2; 493/464, 967

(56) References Cited

U.S. PATENT DOCUMENTS

| | | | | | |
|---|---|---|---|---|---|
| 2,271,180 | A | * | 1/1942 | Brugger | |
| 2,786,399 | A | | 3/1957 | Mason et al. | |
| 2,924,154 | A | | 2/1960 | Russell et al. | |
| 3,509,797 | A | | 5/1970 | Johnson | |
| 3,694,296 | A | * | 9/1972 | Frontino | |
| 3,905,057 | A | | 9/1975 | Willis et al. | |
| 4,026,198 | A | | 5/1977 | Ottaviano | |
| 4,241,832 | A | * | 12/1980 | Bliss | |
| 4,247,289 | A | | 1/1981 | McCabe | |
| 4,937,131 | A | | 6/1990 | Baldacci et al. | |
| 5,088,972 | A | | 2/1992 | Parker | |
| 5,159,895 | A | * | 11/1992 | Helling et al. | 206/584 |
| 5,173,352 | A | | 12/1992 | Parker | |
| 5,257,492 | A | | 11/1993 | Watts | |
| 5,312,665 | A | | 5/1994 | Pratt et al. | |
| 5,568,867 | A | | 10/1996 | Lencoski | |
| 5,593,755 | A | * | 1/1997 | Fuss | |
| 5,615,534 | A | | 4/1997 | Weder | |
| 5,643,647 | A | | 7/1997 | Wischusen, III | |
| 5,661,955 | A | | 9/1997 | Maida et al. | |
| 5,910,089 | A | | 6/1999 | Weder | |
| 5,944,192 | A | * | 8/1999 | Weder | 206/584 |
| 6,053,324 | A | * | 4/2000 | Weder | 206/584 |
| 6,067,779 | A | * | 5/2000 | Weder | 206/584 |
| 6,189,297 | B1 | * | 2/2001 | Weder | 493/464 |
| 6,192,659 | B1 | * | 2/2001 | Weder | 206/584 |
| 6,385,949 | B2 | * | 5/2002 | Weder | 206/584 |

* cited by examiner

*Primary Examiner*—Stephen F. Gerrity
(74) *Attorney, Agent, or Firm*—Dunlap, Codding & Rogers, P.C.

(57) ABSTRACT

A packaging material comprising a plurality of cushioning members for cushioning an article in a container is provided. The cushioning members being formed by crumpling a flexible sheet of material having a plurality of slits extending through the sheet of material and into a globular configuration having a plurality of random folds, a plurality of random engaged portions, and a plurality of voids. The sheet of material has an upper surface and a lower surface with at least one of the upper surface and the lower surface having a bonding material disposed thereon such that at least a portion of the engaged portions are bondably connected thereby increasing the resiliency of the folds.

64 Claims, 8 Drawing Sheets

PACKAGE AND METHOD OF PACKAGING

CROSS-REFERENCE TO RELATED APPLICATIONS

This application is a continuation-in-part of U.S. Ser. No. 09/723,933, filed Nov. 28, 2000; which is a continuation of U.S. Ser. No. 09/289,506, filed Apr. 9, 1999, now U.S. Pat. No. 6,189,297; which is a continuation of U.S. Ser. No. 08/899,249 filed Jul. 23, 1997, now U.S. Pat. No. 5,910,089.

STATEMENT REGARDING FEDERALLY SPONSORED RESEARCH OR DEVELOPMENT

Not applicable.

BACKGROUND OF THE INVENTION

1. Field of the Invention

The present invention relates generally to cushioning materials for packaging articles, and more particularly, but not by way of limitation, to a packaging material comprising a plurality of cushioning members wherein each of the cushioning members is formed of a crumpled sheet of flexible material having a plurality of slits therein for controlling resiliency and a bonding material disposed thereon for bondably connecting overlapping portions of the crumpled sheet of material to enhance the resiliency of the crumpled sheet of material.

2. Brief Description of the Related Art

In the process of shipping an article from one location to another, the article is typically placed in a container along with a protective packaging material to fill the voids about the article and to cushion the article during the shipping process. One common protective packaging material is comprised of a plurality of plastic foam, peanut-shaped members, which are commonly known as "styrofoam peanuts." An advantage of using styrofoam peanuts is the ease with which they may be disposed about an article positioned in a container by simply pouring the styrofoam peanuts from a dispenser.

Styrofoam peanuts have been widely accepted in the packaging industry, however, they are not without disadvantages. For example, the light weight and flowability of the styrofoam peanuts results in heavier objects gravitating through the peanuts to the bottom of the container where the object can be damaged. Also, while the flowability of the styrofoam peanuts facilitates the introduction of the peanuts into a container, the receiver of the package is left with having to deal with the peanuts upon removal of the article from the container in the form of having to clean up the mess left by the peanuts which are easily scattered upon removal of the article from the container.

These disadvantages, as well as the environmental problems associated with the disposal of styrofoam peanuts, has made paper protective packaging material a popular alternative. Paper is biodegradable, recyclable and renewable, making it an environmentally responsible choice. However, like styrofoam peanuts, paper packaging materials, such as crumpled sheets of newsprint, are not without disadvantages in that they are generally not very resilient, and thus, large amounts of paper are required to provide the bulk needed to adequately cushion an article.

An example of a paper cushioning product is disclosed in U.S. Pat. No. 5,568,867, issued to Lencoski. More specifically, Lencoski U.S. Pat. No. 5,568,867, teaches a thimble shaped cushioning product formed from a sheet of paper. The cushioning product is formed by inserting a punch through a die with a sheet of paper positioned therebetween so as to form the sheet of paper into the thimble shaped cushioning product. The cushioning product includes a closed lower end, an open upper end, and a tubular sidewall having a plurality of overlapping folds formed therein. Again, the problem encountered in the use of the paper cushioning product of Lencoski U.S. Pat. No. 5,568,867, is that the flexibility of the paper results in the cushioning product not being able to retain its shape when subjected to compressive stresses. Thus, the cushioning products are easily crushed and deformed whereby voids can develop about the packed article during the shipping process and the resiliency or cushioning effect provided by the cushioning products can quickly deteriorate.

U.S. Pat. Nos. 3,655,500, 4,109,040 and 4,717,613, disclose cushioning dunnage products formed of a flexible, multi-ply stock material wherein the edges of the stock material are rolled inwardly to form pillow-like portions which are connected together along their engaged abutting sides by coining or adhesive. While such dunnage products have achieved varying degrees of success, the manufacture of such products requires the use of specific equipment which dictates that such products be manufactured and then shipped to the end user rather than formed by the end user. This in turn leads to increased costs in the form of manufacturing and the storage and shipping of a voluminous product.

To this end, an improved packaging material is needed which can be manually or mechanically formed from a sheet of flexible material into a controllable resilient cushioning member and which can be formed just prior to use. It is to such a packaging material that the present invention is directed.

BRIEF SUMMARY OF THE INVENTION

The present invention is directed to a cushioning member for use as a packaging material. The cushioning member is formed of a flexible sheet of material crumpled into a globular configuration such that the sheet of material has a plurality of random folds, a plurality of random engaged portions and a plurality of voids. The sheet of material has a plurality of slits, an upper surface and a lower surface with at least one of the upper and lower surfaces having a bonding material disposed thereon such that at least a portion of the engaged portions of the sheet of material are bondably connected thereby increasing the resiliency of the folds.

The present invention also provides a method of forming a cushioning member for use in packaging an article which generally includes the steps of providing a sheet of material having a bonding material disposed on at least one side thereof, and crumpling the sheet of material into a globular configuration such that the sheet of material has a plurality of random folds, a plurality of random engaged portions and a plurality of voids such that, at least a portion of the engaged portions are bondably connected.

In one embodiment, the sheet of material is provided in a pad of a plurality of sheets of material whereby the sheet of material is removed from the pad prior to crumpling the sheet of material.

A plurality of the cushioning members may be incorporated into a package which additionally includes a container and an article positioned within the container. The cushioning members may be positioned into the container to substantially surround the article positioned within the container. In this manner, the cushioning members will function as a protective packaging material which cushions the article during a shipping process.

The features and advantages of the present invention will become apparent from the following detailed description when read in conjunction with the accompanying drawings and appended claims.

DETAILED DESCRIPTION OF THE INVENTION

Figure 1:
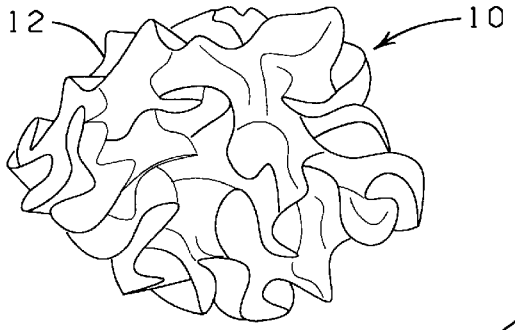
FIG. 1 is a perspective view of a cushioning member constructed in accordance with the present invention.
Figure 2:
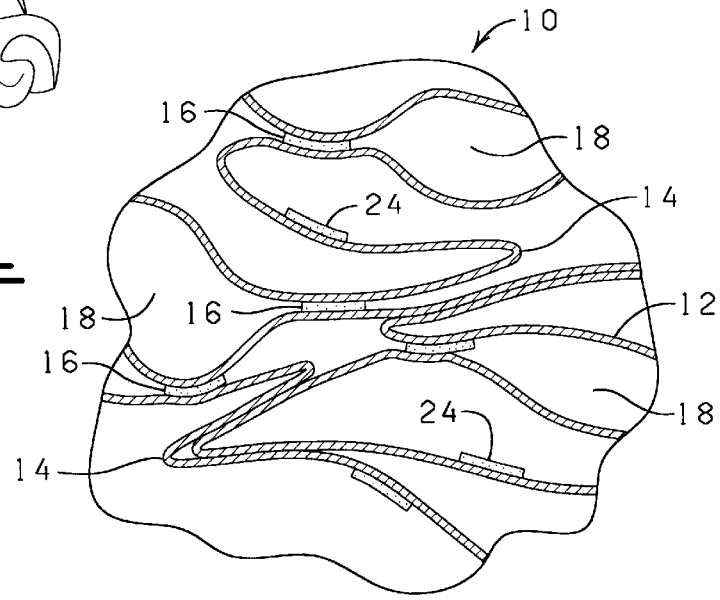
FIG. 2 is an enlarged sectional view of a portion of the cushioning member of FIG. 1.

Referring now to the drawings, and more particularly to FIGS. 1 and 2, a cushioning member 10 constructed in accordance with the present invention is illustrated. The cushioning member 10 is formed from a sheet of material 12 which is flexible and can be crumpled into a cubical, rectangular, spherical, or otherwise globular configuration having a plurality of random folds 14, a plurality of random engaged portions 16, and a plurality of voids 18. The sheet of material 12 can be crumpled to form the cushioning member 10 manually or with a suitable apparatus, such as that disclosed in U.S. Pat. No. 2,924,154, issued to Russell et al. on Feb. 9, 1960, which is hereby expressly incorporated herein by reference.

Figure 3:
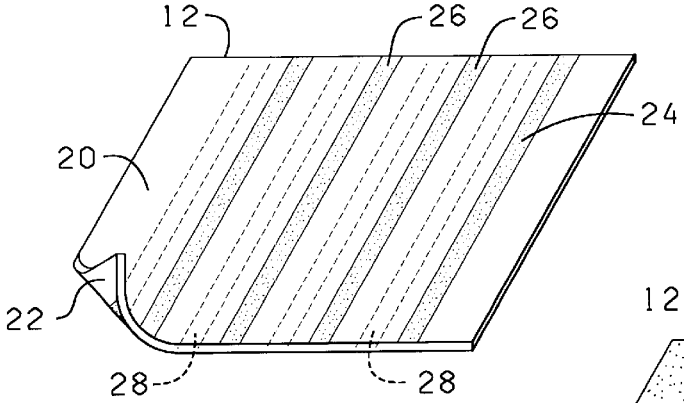
FIG. 3 is a perspective view of a sheet of material for use in forming the cushioning member of the present invention.

Referring now to FIG. 3, the sheet of material 12 is a substantially square or rectangle sheet of material having a length of approximately two to four feet and a width of approximately two to four feet. However, it will be appreciated that the dimensions of the sheet of material 12 may be varied. The sheet of material 12 can be any flexible sheet of material, including paper, crepe paper, polymeric film, laminated polymeric film and waxed paper, for example. The sheet of material 12 may have printed matter and/or embossed pattern on at least one side thereof, and the embossed pattern can be either in register or out of register with the printed pattern. Different colors can be employed to provide the printed pattern on the sheet of material 12.

The sheet of material 12 can also be embossed so as to provide the sheet of material 12 with an embossed pattern. Further, the sheet of material 12 can be provided with an embossed pattern as well as a printed pattern, and the embossed pattern can be either in register or out of register with the printed material and/or printed design.

The sheet of material 12 may be constructed of a single layer of material or a plurality of layers of the same or different types of materials. In addition, any thickness of the sheet of material 12 may be utilized with the present invention so long as the sheet of material 12 is shapeable into the cushioning member 10.

Although the sheet of material 12 shown in FIG. 3 is square, the sheet of material 12 may be any shape. For example, the sheet of material 12 may be square, rectangular, circular or any other geometric shape. The shape of the sheet of material 12 may even have an irregular, capricious or decorative shape.

The cushioning effect provided by the cushioning member 10 results from the resiliency of the plurality of random folds 14 and the volume provided by the plurality of voids 18. However, as mentioned above, crumpled sheets of material, particularly crumpled sheets of paper, are generally not very resilient, and thus, large amounts of material are required to provide the bulk needed to adequately cushion an article. In an effort to overcome these drawbacks, the present invention contemplates bondably connecting the plurality of random engaged portions 16 of the sheet of material 12 thereby imparting an additional degree of stiffness to the cushioning member 10 so as to enhance the resiliency of the cushioning member 10, and at the same time, provide the opportunity to reduce the weight of packaging material through the use of thinner and fewer sheets of material.

To achieve these desired effects, the sheet of material 12 is coated with a bonding material such as an adhesive or cohesive whereby at least a portion of the plurality of random engaged portions 16 of the sheet of material 12 are caused to bond together when the sheet of material 12 is crumpled into the cushioning member 10 illustrated in FIG. 1. More specifically, the sheet of material 12, illustrated in FIG. 3, has an upper surface 20, a lower surface 22, and a bonding material 24 disposed on the upper surface 20 and the lower surface 22. In FIG. 3, the sheet of material 12 is illustrated as being strip coated with the bonding material 24 on the upper surface 20 and the lower surface 22 wherein the bonding material 24 is disposed in the form of a plurality of parallel, spaced apart strips 26 on the upper surface 20 and a plurality of parallel, spaced apart strips 28 on the lower surface 22. The plurality of parallel spaced apart strips 28 of bonding material 24 on the lower surface 22 of the sheet of material 12 are preferably in a staggered relationship relative to the plurality of parallel spaced apart strips 26 of the bonding material 24 on the upper surface 20 of the sheet-of material 12. However, it will be appreciated that the plurality of parallel spaced apart strips 28 of the bonding material 24 on the lower surface 22 of the sheet of material 12 can be aligned with the plurality of parallel spaced apart strips 26 of the bonding material 24 on the upper surface 20, formed in a diagonal or perpendicular relationship, or strips of the bonding material 24 may be disposed on only one of the upper surface 20 or the lower surface 22.

Figure 4:
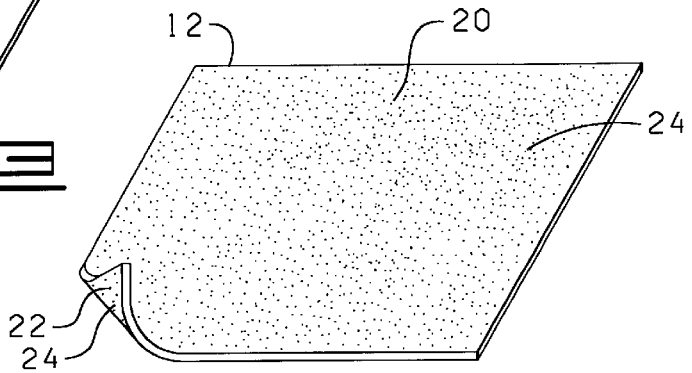
FIG. 4 is a perspective view of another sheet of material for use in forming the cushioning member of the present invention.

Alternatively, as illustrated in FIG. 4, the bonding material 24 may be applied in such a manner as to substantially coat both the upper surface 20 and the lower surface 22 of the sheet of material 12. It will be further appreciated that the bonding material 24 may be disposed on only one of the upper surface 20 or the lower surface 22 or disposed in any of a variety of other patterns such as circles, dots or any other geometric or biomorphic shape, including decorative designs, so long as the bonding material 24 is positioned to function in accordance with the present invention.

The term "bonding material " as used herein can mean an adhesive, frequently a pressure sensitive adhesive, or a cohesive or any adhesive/cohesive combination, having adhesive qualities (i.e., qualities of adhesion or adhesion/cohesion, respectively) sufficient to effect the connection between portions of the sheet of material 12 brought into engagement with one another. It will be appreciated that both adhesives and cohesives suitable for the purposes described herein are well known in the art, and both are commercially available.

Referring again to FIG. 2, the plurality of random engaged portions 16 of the cushioning member 10 are formed by overlapping portions of the sheet of material 12 and bringing such overlapping portions into engagement or contact with one another during the crumpling process. In this manner, the plurality of random engaged portions 16 that are coated with the bonding material 24 are fixed to one another.

By bondably connecting portions of the cushioning member 10, the degree of resiliency of the cushioning member 10 can be controlled. That is, depending on the surface of the sheet of material 12 the bonding material 24 is applied to, the pattern in which the bonding material 24 is applied, and the tackiness of the bonding material 24 used, the cushioning member 10 will be formed with a variety of degrees of voids and rigidity. For example, if the bonding material 24 is applied to the upper surface 20 of the sheet of material 12 so as to coat the entire upper surface 20, as shown in FIG. 4, and the sheet of material 12 is formed into the cushioning member 10 so that the upper surface 20 of the sheet of material 12 is predominately within the interior of the cushioning member 10, opposing portions of the cushioning member 10 defining the plurality of voids 18 may have a tendency to bond when a compressive force is applied to the cushioning member 10, thereby reducing the resiliency of the cushioning member 10. The use of bonding materials with a lesser degree of tack can alleviate the bonding of the portions defining the plurality of voids 18, as well as the application of the bonding material to less than the entire upper surface 20 of the sheet of material 12, such as in the form of strips, spots, and the like. Also, the use of a stiffer bonding material can increase the rigidity of the sheet of material 12 and thus increase the resiliency of the cushioning member 10.

If the bonding material 24 is applied to the lower surface 22 of the sheet of material 12 so as to coat the entire lower surface 22, and the sheet of material 12 is formed into the cushioning member 10 so that the lower surface 22 of the sheet of material 12 predominately forms the exterior surface of the cushioning member 10, the adjacent cushioning members 10 may have a tendency to bond or stick together. Again, the use of bonding materials 24 with a lesser degree of tack, as well as the application of the bonding material 24 to less than the entire lower surface 22 of the sheet of material 12, such as in the form of strips, spots, and the like, can alleviate this condition if it is undesirable. In some instances, however, it may be desirable for the cushioning members 10 to adhere to one another to form a cohesive or unitary cushioning unit, as described below.

Figure 5:
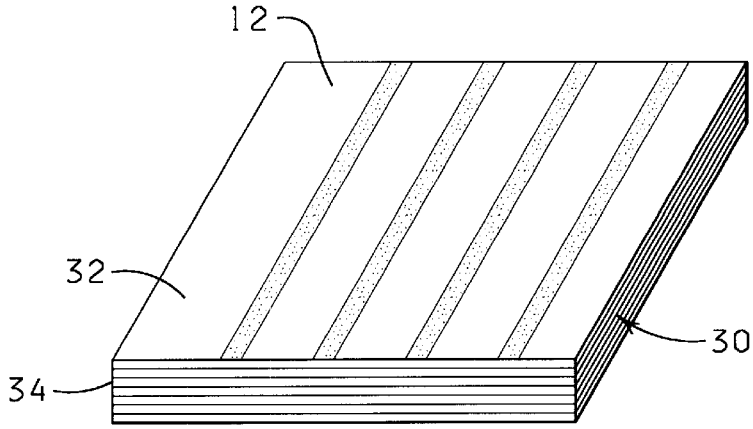
FIG. 5 is a perspective view of a pad of a plurality of the sheets of material of FIG. 3.

As illustrated in FIG. 5, the present invention further contemplates the plurality of sheets of material 12 connected together to form a pad 30 of sheets of material 12. The pad 30 comprises a plurality of sheets of material 12 stacked one on top of the other and positioned so that the periphery of the sheets of material 12 in the pad 30 are generally aligned. The pad 30 is characterized has having a top sheet of material 32 and a next sheet of material 34 disposed thereunder, the other sheets of material 32 being disposed under the next sheet of material 34 in the pad 30 of sheets of material 12.

The top sheet of material 32 is capable of being disconnected from the pad 30 of sheets of material 12. When the top sheet of material 32 is disconnected from the pad 30, the next sheet of material 34 forms the new top sheet of material 32, and the sheet of material lying under the new top sheet of material 32 forms the new next sheet of material 34.

In a general method of use, the top sheet of material 32 is removed or disconnected from the pad 30 of sheets of material 12. The removed sheet of material is then crumpled into the cushioning member 10, as described above, such that the cushioning member 10 has a plurality of random folds 14, a plurality of random engaged portions 16, and a plurality of voids 18 and such that at least a portion of the random engaged portions 16 are bondably connected.

Figure 6:
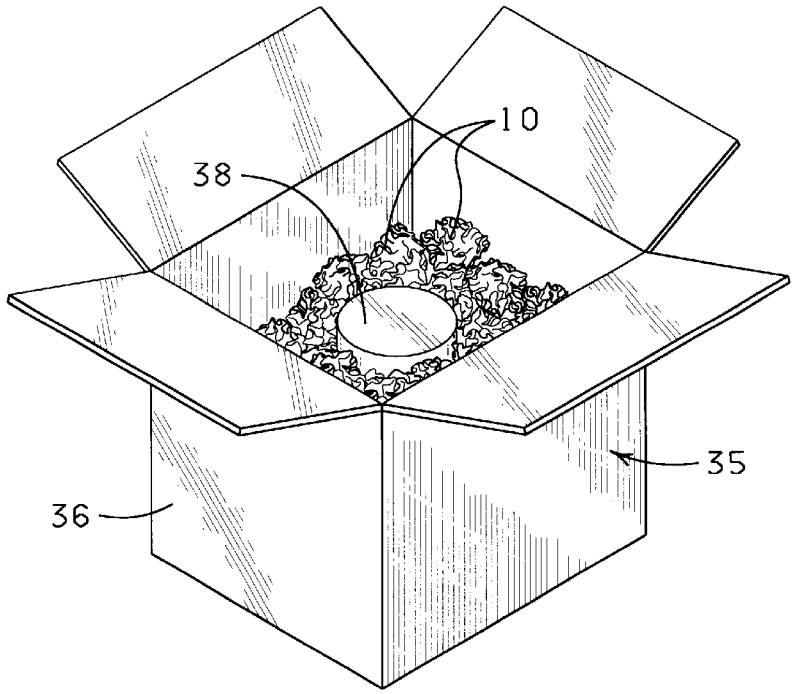
FIG. 6 is a perspective view of a package incorporating a plurality of cushioning members constructed in accordance with the present invention.

Referring now to FIG. 6, a plurality of the cushioning members 10 are shown incorporated into a package 35. The package 35 includes a container 36 and an article 38 positioned within the container 36. The cushioning members 10 may be positioned in the container 36 so as to substantially surround the article 38 positioned within the container 36. In this manner, the cushioning members 10 will function as a protective packaging material filling voids about the article 38 and supporting and cushioning the article 38 during a shipping process.

Figure 7:
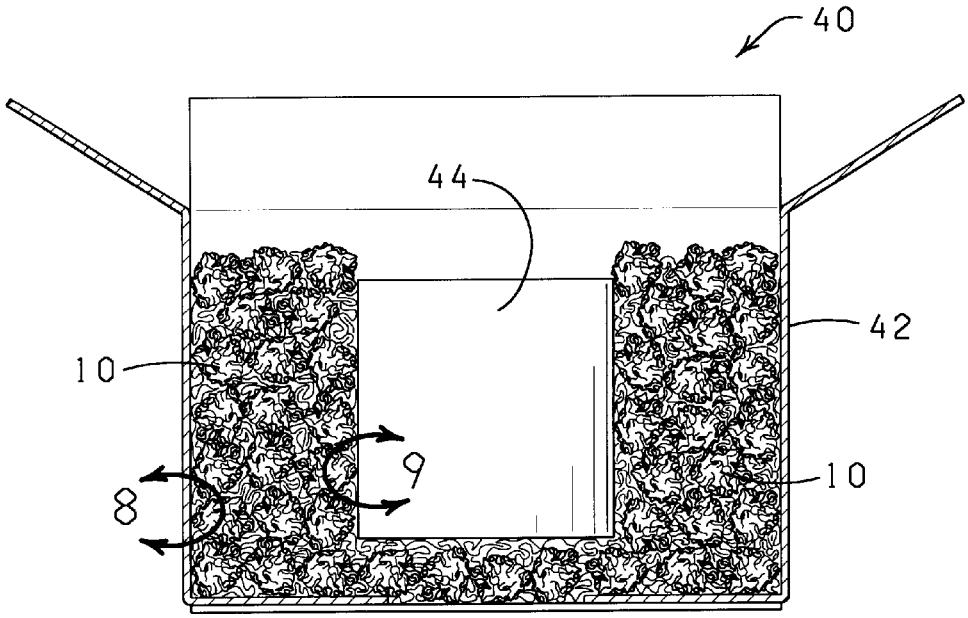
FIG. 7 is a sectional view of a package incorporating a plurality of cushioning members constructed in accordance with the present invention.

FIG. 7 is a sectional view of another package 40 having a plurality of the cushioning members 10 incorporated therein. The package 40 includes a container 42 and an article 44 positioned within the container 42. Like the package 35, the cushioning members 10 are positioned in the container 42 so as to substantially surround the article 44 positioned within the container 42. In this manner, the cushioning members 10 will function as a protective packaging filling voids about the article 44 and supporting and cushioning the article 44 during a shipping process.

Figure 8:
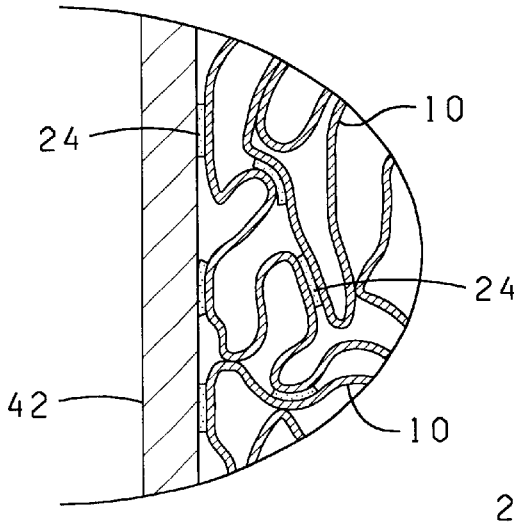
FIG. 8 is an enlarged, sectional view taken along arc 8 in FIG. 7 illustrating the cushioning members bondably connected to each other and the interior surface of a container.
Figure 9:
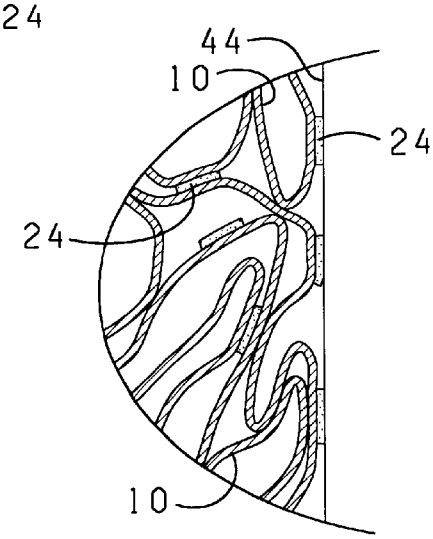
FIG. 9 is an enlarged, sectional view taken along arc 9 in FIG. 7 illustrating the cushioning members bondably connected to each other and the exterior surface of an article disposed in the container.

In addition to the bonding material 24 of the cushioning members 10 illustrated in FIG. 7 serving to bondably connect to the plurality of random engaged portions 16 of each of the individual cushioning members 10, the bonding material 24 is further illustrated in FIGS. 8 and 9 as serving to bondably connect the adjacently disposed cushioning members 10 to form a unitary cushioning unit and bondably connecting a portion of the cushioning members 10 to the interior surface of the container 42 (FIG. 8) and a portion of the cushioning members 10 to the exterior surface of the article 44 (FIG. 9).

One of the advantages of the formation of a unitary cushioning unit with the cushioning members 10 is that the mess associated with scattering of loose or flowable packing material upon removing the article from the container is alleviated. Another advantage of the formation of a unitary cushioning unit with the cushioning members 10 is that gravitation of the article through the cushioning members 10 to the sides of the container where the article 38 can become damaged, is prevented when the article 38 is surrounded by the unitary cushioning unit.

Figure 10:
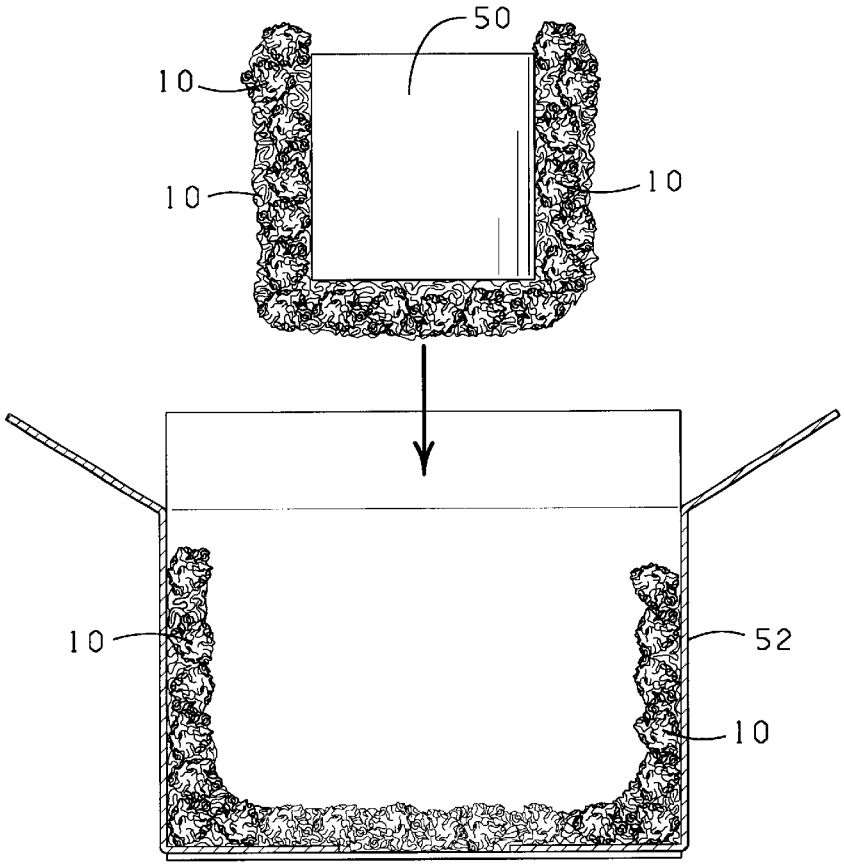
FIG. 10 is a sectional view of a package illustrating an article having a plurality of cushioning members constructed in accordance with the present invention bondably connected to the exterior surface of the article prior to the article being disposed in a container.

FIG. 10 illustrates another method of packaging an article 50 in a container 52 with the cushioning members 10 of the present invention. In this instance, a plurality of the cushioning members 10 are bondably connected to the exterior surface of the article 50 prior to the article 50 being placed into the container 52. A plurality of the cushioning members 10 can also be bondably connected to the interior surfaces of the container 52. In this manner, the article 50 is ensured of being adequately surrounded by the cushioning members 10 once the article 50 is placed into the container 52. In other words, because of the bonding material 24 on the cushioning members 10, the cushioning members 10 are not as flowable as conventional cushioning material thereby, ensuring that the article 50 is adequately surrounded by the cushioning members 10 without large voids remaining between the article 50 and the container 52. Furthermore, bondably connecting the cushioning members 10 to the article 50 prior to the article 50 being placed into the container 52, may in many instances facilitate the packing process. Also, after positioning the article 50 into the container 52, the remaining voids between the article 50 and the container 52 can be easily filled with the additional cushioning members 10.

Figure 11:
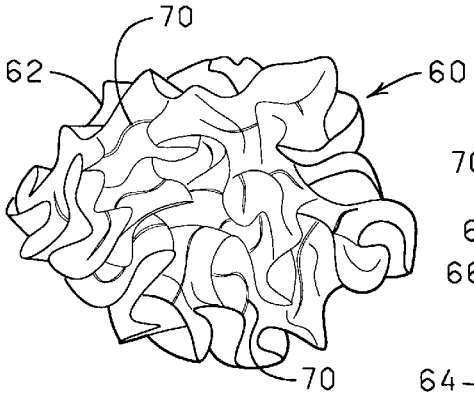
FIG. 11 is a perspective view of another embodiment of a cushioning member constructed in accordance with the present invention.
Figure 12:
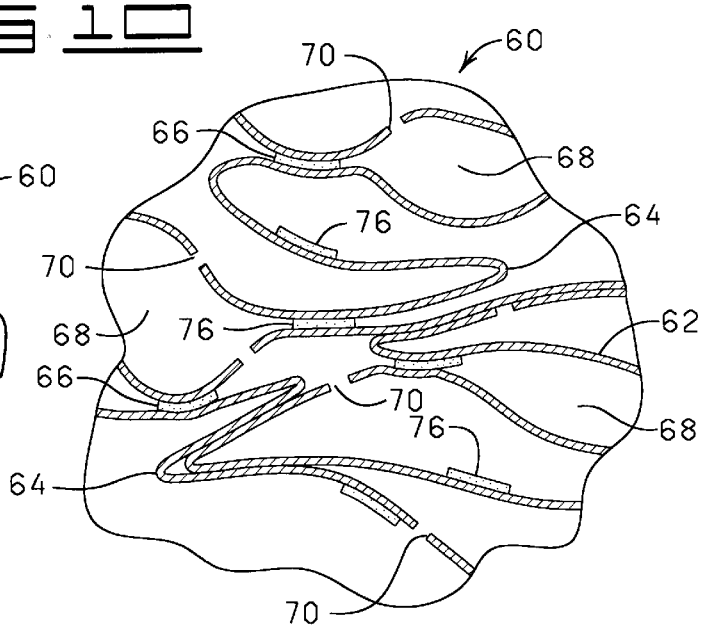
FIG. 12 is an enlarged sectional view of a portion of the cushioning member of FIG. 11.

Referring now to FIGS. 11 and 12, another embodiment of a cushioning member 60 constructed in accordance with the present invention is shown therein. The cushioning member 60 is formed from a sheet of material 62 which is flexible and can be crumpled into a cubical, rectangular, spherical, or otherwise globular configuration having a plurality of random folds 64, a plurality of random engaged portions 66, and a plurality of voids 68. The sheet of material 62 can be crumpled to form the cushioning member 60 manually or with a suitable apparatus, such as that disclosed in U.S. Pat. No. 2,924,154, issued to Russell et al. on Feb. 9, 1960, which is hereby expressly incorporated herein by reference.

The sheet of material 62 used to construct the cushioning member 60 is similar to the sheet of material 12 used to construct the cushioning member 10 described above. In fact, the sheet of material 62, utilized to construct the cushioning member 60, includes all the elements, options, features and advantages of the sheet of material 12 utilized to construct the cushioning member 10. However, the sheet material 62 utilized to construct the cushioning member 60 also includes a plurality of slits 70 extending through the sheet of material 62. The additional advantage provided by the plurality of slits 70 in the sheet of material 62 is that by varying the number of the slits 70, the shape of the slits 70, the length and width of the slits 70, and the distance between the slits 70, the resiliency of the cushioning member 60 formed from the sheet of material 62 can be controlled. Also, the tear strength, tensile strength, and burst strength of the sheet material 62 can be controlled by the direction of the slits in the sheet of material 62 relative to the grain direction of the sheet material 62, if the sheet of material 62 is a non-woven fibrous material such as paper. Furthermore, the present embodiment contemplates combining the aforementioned advantage of controlled resiliency resulting from the plurality of the slits 70 in the sheet of material 62 with the advantages of the previous embodiment of the invention provided by applying a bonding material to the sheet of material 62.

Figure 13:
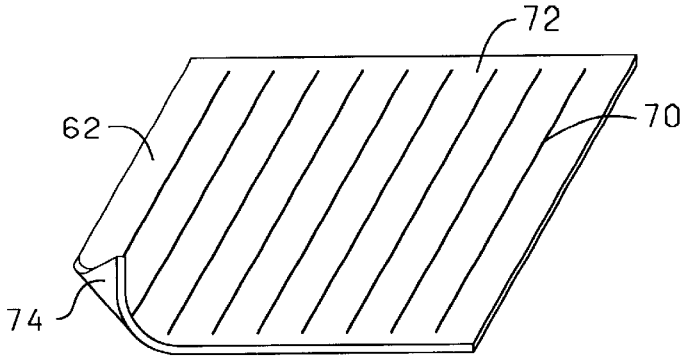
FIG. 13 is a perspective view of a sheet of material with a plurality of parallel slits.
Figure 14:
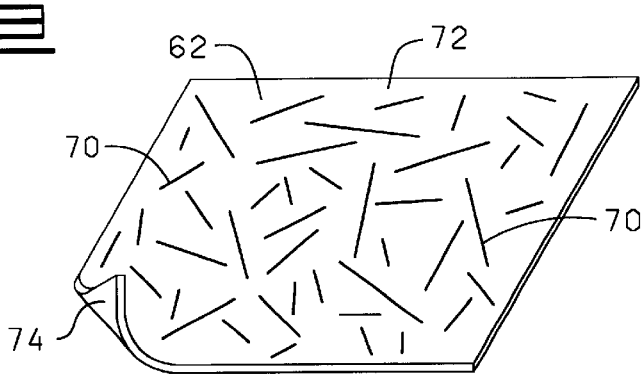
FIG. 14 is a perspective view of a sheet of material with a plurality of random slits.
Figure 15:
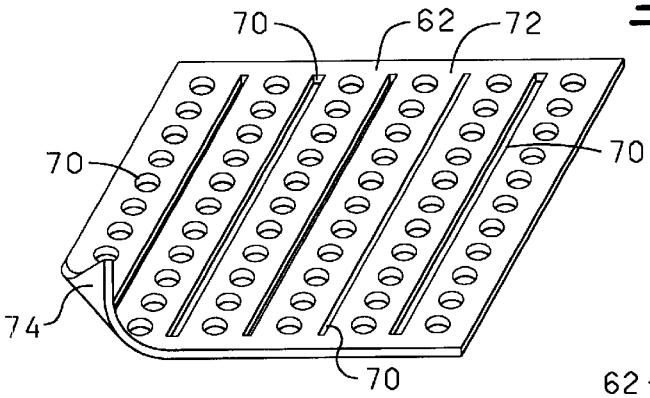
FIG. 15 is a perspective view of a sheet of material with a plurality of geometric slits.

Referring now to FIG. 13, the plurality of slits 70 in the sheet of material 62 can be, by way of example, uniform and parallel. Alternatively, the plurality of slits 70 can be random and of non-uniform length, as shown in FIG. 14. The plurality of slits 70 are preferably linear and non-intersecting although the plurality of slits 70 may be intersecting, non-linear, curved, or of any desired geometric shape such as circles, hexagons, ovals, ellipses, squares, rectangles, stars or other fanciful, perhaps decorative shapes as shown in FIG. 15.

Figure 16:
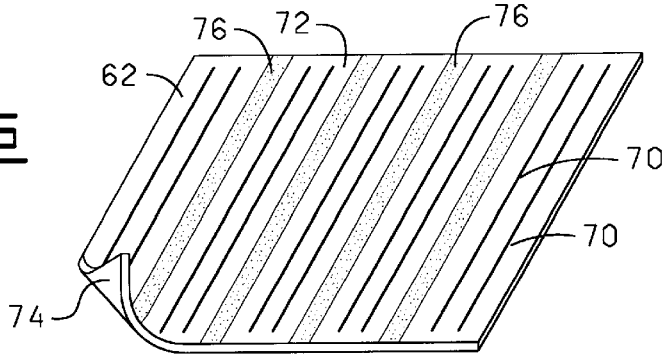
FIG. 16 is a perspective view of a sheet of material with a plurality of slits therein and strips of bonding material thereon for use in forming the cushioning member of FIG. 11.

Referring now to FIG. 16, the sheet of material 62 is a substantially square sheet of material having a length of approximately two to four feet and a width of approximately two to four feet. However, it will be appreciated that the dimensions of the sheet of material 62 may be varied. The sheet of material 62 can be any flexible sheet of material, including, paper, crepe paper, polymeric film, laminated polymeric film, and waxed paper, for example. The sheet of material 62 may also have printed matter and/or embossed pattern on at least one side thereof, and the embossed pattern can be either in register or out of register with the printed pattern. Different colors can be employed to provide the printed pattern on the sheet of material 62.

The sheet of material 62 can also be embossed so as to provide the sheet of material 62 with an embossed pattern. Further, the sheet of material 62 can be provided with an embossed pattern as well as a printed pattern, and the embossed pattern can be either in register or out of register with the printed material and/or printed design.

The sheet of material 62 may be constructed of a single layer of material or a plurality of layers of the same or different types of materials. In addition, any thickness of the sheet of material 62 may be utilized with the present invention so long as the sheet of material 62 is shapeable into the cushioning member 60.

Although the sheet of material 62 shown in FIG. 16 is square, the sheet of material 62 may be any shape. For example, the sheet of material 62 may be square, circular or any other geometric shape. The shape of the sheet of material 62 may even have an irregular, capricious or decorative shape.

The cushioning effect provided by the cushioning member 60 results from the resiliency of the plurality of random folds 64, and the volume provided by the plurality of voids 68. However, crumpled sheets of material, particularly crumpled sheets of paper, are generally not very resilient, and thus, large amounts of material are required to provide the bulk needed to adequately cushion an article. In an effort to overcome these drawbacks, the present invention contemplates bondably connecting the plurality of random engaged portions 66 of the sheet of material 62 thereby imparting an additional degree of stiffness to the cushioning member 60 so as to enhance the resiliency of the cushioning member 60, and at the same time, provide the opportunity to reduce the weight of packaging material through the use of thinner and fewer sheets of material.

To achieve these desired effects, the sheet of material 62 is coated with a bonding material such as an adhesive or cohesive whereby at least a portion of the plurality of random engaged portions 66 of the sheet of material 62 are caused to bond together when the sheet of material 62 is crumpled into the cushioning member 60 illustrated in FIG. 11. More specifically, the sheet of material 62, illustrated in FIG. 16, has the plurality of slits 70, an upper surface 72, a lower surface 74, and a bonding material 76 disposed on the upper surface 72 and the lower surface 74. In FIG. 16, the sheet of material 62 is illustrated as being strip coated with the bonding material 76 on the upper surface 72 and the lower surface 74 wherein-the bonding material 76 is disposed in the form of a plurality of parallel, spaced apart strips 78 on the upper surface 72 and the plurality of parallel, spaced apart strips 78 on the lower surface 74. The strips 78 of the bonding material 76 on the lower surface 74 of the sheet of material 62 are preferably in a staggered relationship relative to the strips 78 of the bonding material 76 on the upper surface 72 of the sheet of material 62. However, it will be appreciated that the strips 78 of bonding material 76 on the lower surface 74 of the sheet of material 62 can be aligned with the strips 78 of the bonding material 76 on the upper surface 72, formed in a diagonal or perpendicular relationship, or strips of the bonding material 76 may be disposed on only one of the upper surface 72 or the lower surface 74.

Figure 17:
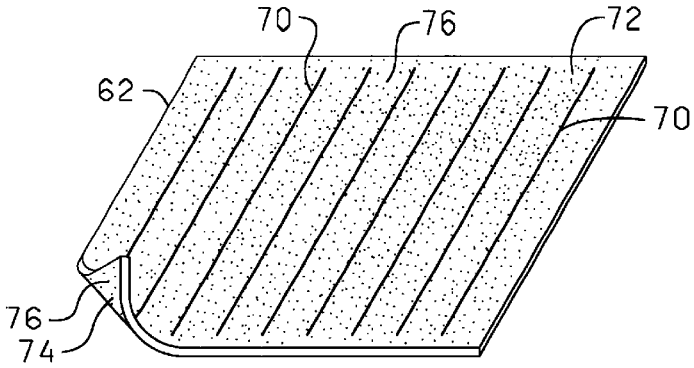
FIG. 17 is a perspective view of another sheet of material with a plurality of slits and a coating of bonding material thereon for use in forming the cushioning member of the present invention.

Alternatively, as illustrated in FIG. 17, the bonding material 76 may be applied in such a manner as to substantially coat both of the upper surface 72 and the lower surface 74 of the sheet of material 62. It will be further appreciated that the bonding material 76 may be disposed on only one of the upper surface 72 or the lower surface 74 or disposed in any of a variety of other patterns such as circles, dots or any other geometric or biomorphic shape, including decorative designs, so long as the bonding material 76 is positioned to function in accordance with the present invention.

Referring again to FIG. 12, the plurality of random engaged portions 66 of the cushioning member 60 are formed by overlapping portions of the sheet of material 62 and bringing such overlapping portions into engagement or contact with one another during the crumpling process. In this manner, the plurality of random engaged portions 66 that are coated with the bonding material 76 are fixed to one another.

By bondably connecting portions of the cushioning member 60, the degree of resiliency of the cushioning member 60 can be controlled. That is, depending on which of the surfaces of the sheet of material 62 the bonding material 76 is applied to, the pattern in which the bonding material 76 is applied, and the tackiness of the bonding material 76 used, the cushioning member 60 will be formed with a variety of degrees of voids and rigidity. For example, if the bonding material 76 is applied to the upper surface 72 of the sheet of material 62 so as to coat the entire upper surface 66, as shown in FIG. 17, and the sheet of material 62 is formed into the cushioning member 60 so that the upper surface 72 of the sheet of material 62 is predominately within the interior of the cushioning member 60, opposing portions of the cushioning member 60 defining the plurality of voids 68 may have a tendency to bond when a compressive force is applied to the cushioning member 60, thereby reducing the resiliency of the cushioning member 60. The use of bonding materials with a lesser degree of tack can alleviate the bonding of the portions defining the plurality of voids 68, as well as the application of the bonding material 76 to less than the entire upper surface 72 of the sheet of material 62, such as in the form of strips, spots, and the like. Also, the use of a the stiffer bonding material 76 can increase the rigidity of the sheet of material 62 and thus increase the resiliency of the cushioning member 60.

If the bonding material 76 is applied to the lower surface 74 of the sheet of material 62 so as to coat the entire lower surface 74, and the sheet of material 62 is formed into the cushioning member 60 so that the lower surface 74 of the sheet of material 62 predominately forms the exterior surface of the cushioning member 60, adjacent the cushioning members 60 may have a tendency to bond or stick together. Again, the use of bonding materials with a lesser degree of tack, as well as the application of the bonding material to less than the entire lower surface 74 of the sheet of material 62, such as in the form of strips, spots, and the like, can alleviate this condition if it is undesirable. In some instances, however, it may be desirable for the cushioning members 60 to adhere to one another to form a cohesive or unitary cushioning unit, as described below.

Figure 18:
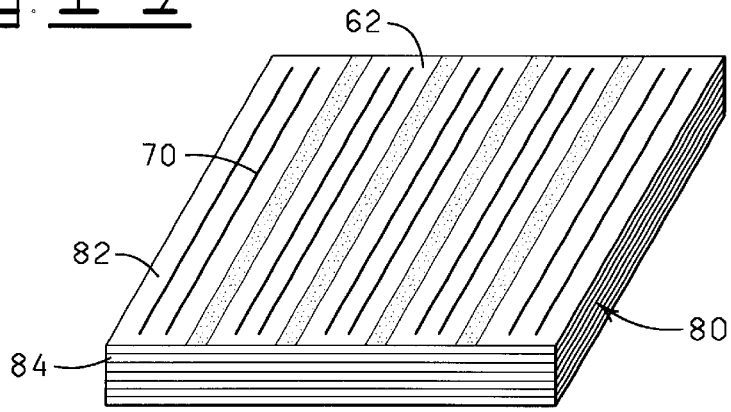
FIG. 18 is a perspective view of a pad of a plurality of the sheets of material of FIG. 16.

As illustrated in FIG. 18, the present invention further contemplates a plurality of the sheets of material 62 connected together to form a pad 80 of the sheets of material 62. The pad 80 comprises a plurality of the sheets of material 62 stacked one on top of the other and positioned so that the periphery of the sheets of material 62 in the pad 80 are generally aligned. The pad 80 is characterized as having a top sheet of material 82 and a next sheet of material 84 disposed thereunder, the other sheets of material being disposed under the next sheet of material 84 in the pad 80 of the sheets of material 62.

The top sheet of material 82 is capable of being disconnected from the pad 80 of the sheets of material 62. When the top sheet of material 82 is disconnected from the pad 80, the next sheet of material 84 forms the new top sheet of material 82, and the sheet of material lying under the new top sheet of material 82 forms the new next sheet of material 84.

In a general method of use, the top sheet of material 82 is removed or disconnected from the pad 80 of the sheets of material 62. The removed sheet of material 62 is then crumpled into the cushioning member 60, as described above, such that the cushioning member 60 has the plurality of random folds 64, the plurality of random engaged portions 66, and the plurality of voids 68 and such that at least a portion of the engaged portions are bondably connected.

Figure 19:
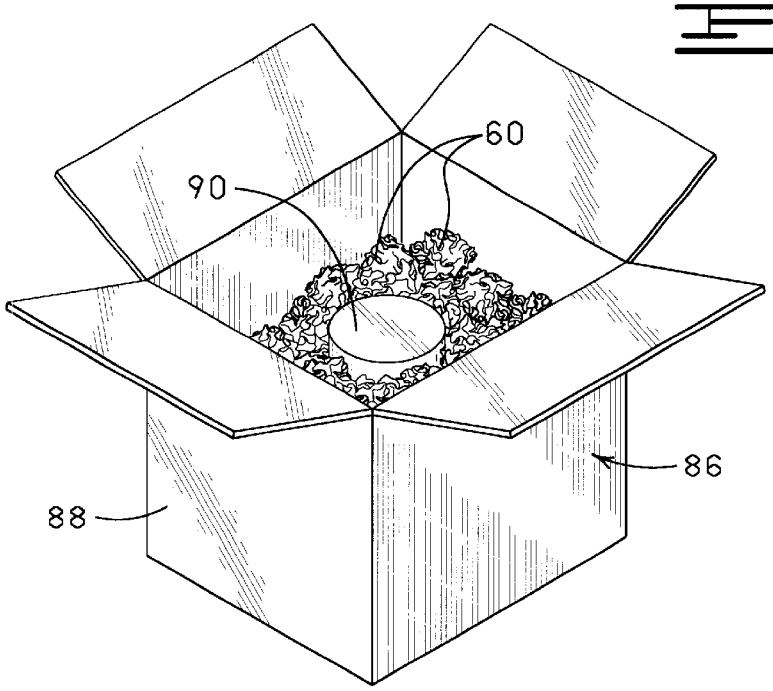
FIG. 19 is a perspective view of a package incorporating a plurality of the cushioning members constructed in accordance with the present invention.

Referring now to FIG. 19, a plurality of the cushioning members 60 are shown incorporated into a package 86. The package 86 includes a container 88 and an article 90 positioned within the container 88. The cushioning members 60 may be positioned in the container 88 so as to substantially surround the article 90 positioned within the container 88. In this manner, the cushioning members 60 will function as a protective packaging material filling voids about the article 90 and supporting and cushioning the article 90 during a shipping process.

Figure 20:
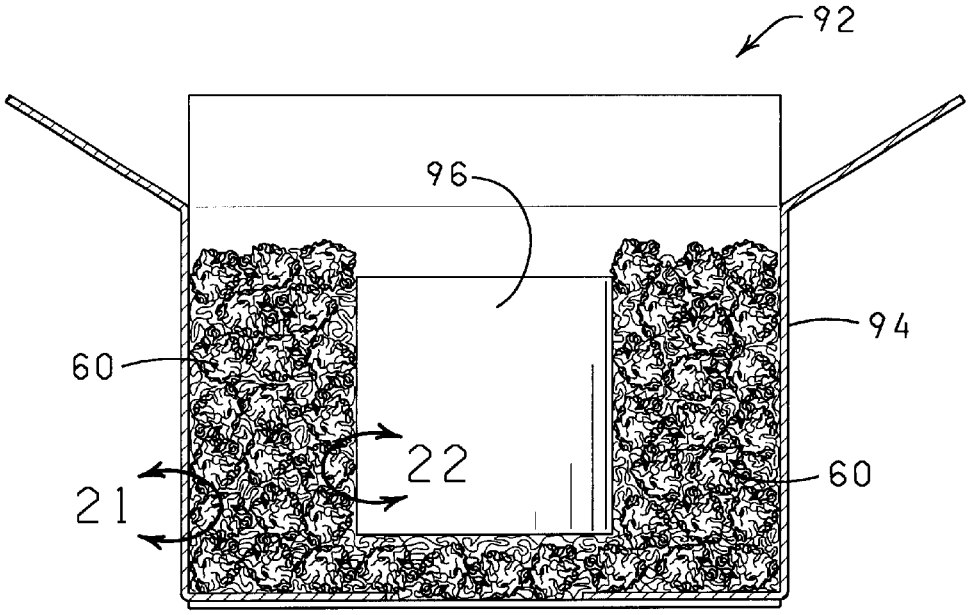
FIG. 20 is a sectional view of a package of FIG. 19 incorporating a plurality of cushioning members shown in FIG. 11 constructed in accordance with the present invention.

FIG. 20 is a sectional view of another package 92 having a plurality of the cushioning members 60 incorporated therein. The package 92 includes a container 94 and an article 96 positioned within the container 94. Like the package 86, the cushioning members 60 are positioned in the container 94 so as to substantially surround the article 96 positioned within the container 94. In this manner, the cushioning members 60 will function as a protective packaging filling voids about the article 96 and supporting and cushioning the article 96 during a shipping process.

Figure 21:
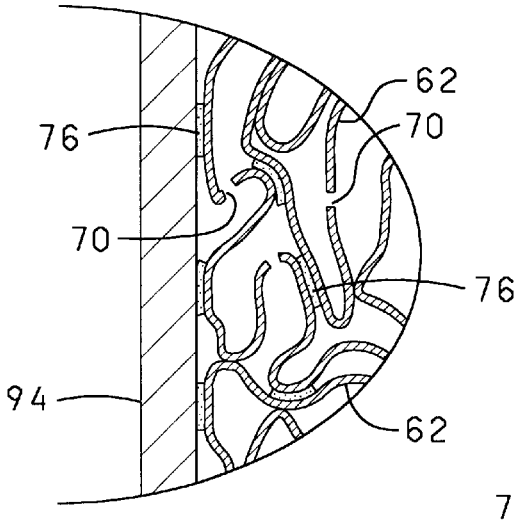
FIG. 21 is an enlarged, sectional view taken along arc 21 in FIG. 20 illustrating the cushioning members bondably connected to each other and the interior surface of a container.
Figure 22:
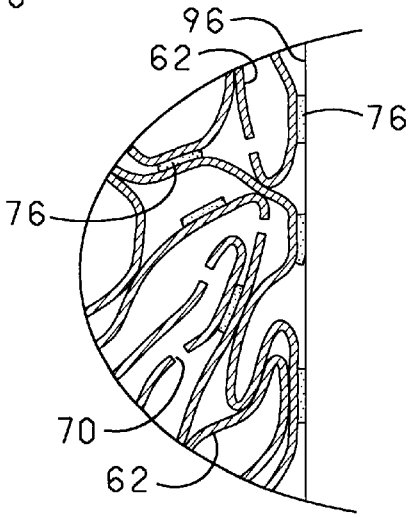
FIG. 22 is an enlarged; sectional view taken along arc 22 in FIG. 20 illustrating the cushioning members bondably connected to each other and the exterior surface of an article disposed in the container.

In addition to the bonding material 76 of the cushioning members 60 illustrated in FIG. 19 serving to bondably connect to the engaged portions of each of the individual cushioning members 60, the bonding material 76 is further illustrated in FIGS. 21 and 22 as serving to bondably connect the adjacently disposed cushioning members 60 to form a unitary cushioning unit and bondably connecting a portion of the cushioning members 60 to the interior surface of the container (FIG. 20) and a portion of the cushioning members 60 to the exterior surface of the article 96 (FIG. 22).

One of the advantages of the formation of a unitary cushioning unit with the cushioning members 60 is that the mess associated with scattering of loose or flowable packing material upon removing the article 96 from the container 881is alleviated. Another advantage of the formation of a unitary cushioning unit with the cushioning members 60 is that gravitation of the article 96 through the cushioning members 60 to the sides of the container where the article 96 can become damaged, is prevented when the article 96 is surrounded by the unitary cushioning unit.

Figure 23:
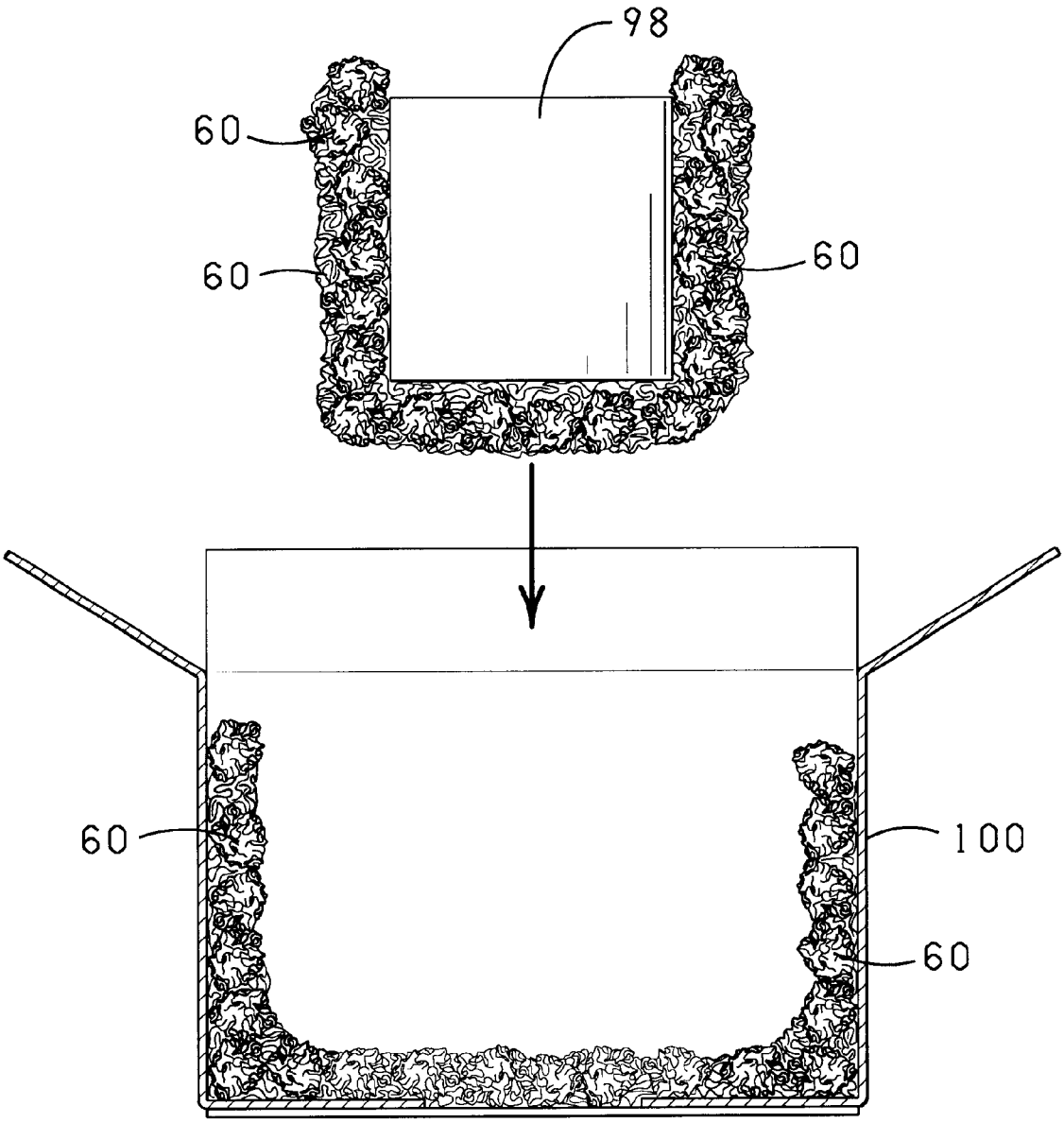
FIG. 23 is a sectional view of a package illustrating an article having a plurality of cushioning members constructed in accordance with the present invention bondably connected to the exterior surface of the article prior to the article being disposed in a container.

FIG. 23 illustrates another method of packaging an article 98 in a container 100 with the cushioning members 60 of the present invention. In this instance, a plurality of the cushioning members 60 are bondably connected to the exterior-surface of the article 98 prior to the article 98 being placed into the container 100. A plurality of the cushioning members 60 can also be bondably connected to the interior surfaces of the container 100. In this manner, the article 98 is ensured of being adequately surrounded by cushioning members 60 once the article 98 is placed into the container 100. In other words, because of the bonding material 76 on the cushioning members 60, the cushioning members 60 are not as flowable as conventional cushioning material. Therefore, to ensure that the article 98 is adequately surrounded by the cushioning members 60 without large voids remaining between the article 98 and the container 100, bondably connecting the cushioning members 60 to the article 98 prior to the article 98 being placed into the container 100 where the article 98 is more accessible may in many instances facilitate the packing process. Upon positioning the article 98 into the container 100, the remaining voids 68 between the article 98 and the container 60 can be more easily filled with the additional cushioning members 60.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. A package, comprising:

a container;

an article positioned in the container; and a plurality of cushioning members positioned in the container so as to substantially surround the article and resiliently support and cushion the article, each of the cushioning members formed of a flexible sheet of material having a plurality of slits extending through the sheet of material, the sheet of material crumpled into a globular configuration such that the sheet of material has a plurality of random folds, a plurality of random engaged portions, and a plurality of voids, the sheet of material having an upper surface and a lower surface with at least one of-the upper surface and the lower surface having a bonding material disposed thereon such that at least a portion of the engaged portions are bondably connected thereby increasing the resiliency of the folds and such that the cushioning members are bondingly connected to the adjacently disposed cushioning members to form a unitary cushioning unit.

2. The package of claim 1 wherein the unitary cushioning unit is bondingly connected to the article.

3. The package of claim 1 wherein the unitary cushioning unit is bondingly connected to the container.

4. The package of claim 1 wherein the unitary cushioning unit is bondingly connected to the article and to the container.

5. The package of claim 1 wherein the bonding material is disposed on the upper surface of the sheet of material in the form of a plurality of spaced apart strips, and wherein the bonding material is disposed on the lower surface of the sheet of material in the form of a plurality of spaced apart strips which are in staggered, parallel relationship relative to the strips of bonding material on the upper surface of the sheet of material.

6. The package of claim 1 wherein the bonding material is disposed on substantially the entire upper surface of the sheet of material, and wherein the bonding material is disposed on substantially the entire lower surface of the sheet of material.

7. The package of claim 1 wherein the bonding material is a pressure sensitive adhesive.

8. The package of claim 1 wherein the bonding material is a cohesive.

9. The package of claim 1 wherein the slits in the sheet of material are further defined as uniform and parallel.

10. The package of claim 1 wherein the slits in the sheet of material are further defined as non-uniform and random.

11. The package of claim 1 wherein the slits in the sheet of material are further defined as non-intersecting.

12. The package of claim 1 wherein the slits in the sheet of material are further defined as intersecting.

13. The package of claim 1 wherein the shape of the slits in the sheet of material is further defined as being chosen from a group of shapes consisting of circles, hexagons, ovals, ellipses, squares, rectangles, stars, fanciful, decorative, linear, non-linear or curved.

14. A method of packaging an article, comprising the steps of:

(a) positioning the article in a container;

(b) providing a flexible sheet of material having a plurality of slits extending through the sheet of material and having a bonding material disposed on at least one surface thereof;

(c) crumpling the sheet of material into a globular configuration such that the sheet of material has a plurality of random folds, a plurality of random engaged portions, and a plurality of voids and such that at least a portion of the engaged portions are bondably connected thereby increasing the resiliency of the folds;

(d) disposing the crumpled sheet of material into the container about the article; and (e) repeating steps (b)–(d) until the article is substantially surrounded by the crumpled sheets of material and each crumpled sheet of material is bondingly connected to the adjacently disposed crumpled sheets of material to provide a unitary cushioning unit about the article, and the crumpled sheets of material in direct contact with the article are caused to be bondably connected to the article.

15. The method of claim 14 further comprising:

causing the unitary cushioning unit to bondingly connect to the article.

16. The method of claim 14 further comprising:

causing the unitary cushioning unit to bondingly connect to the container.

17. The method of claim 14 further comprising:

causing the unitary cushioning unit to bondingly connect to the article and the container.

18. The method of claim 14 wherein the step of providing the sheet of material the slits in the sheet of material are further defined as uniform and parallel.

19. The method of claim 14 wherein the step of providing the sheet of material the slits in the sheet of material are further defined as non-uniform and random.

20. The method of claim 14 wherein the step of providing the sheet of material the slits in the sheet of material are further defined as non-intersecting.

21. The method of claim 14 wherein the step of providing the sheet of material the slits in the sheet of material are further defined as intersecting.

22. The method of claim 14 wherein the step of providing the sheet of material the shape of the slits in the sheet of material is further defined as being chosen from a group of shapes consisting of circles, hexagons, ovals, ellipses, squares, rectangles, stars, fanciful, decorative, linear, non-linear or curved.

23. A method of packaging an article, comprising the steps of:

(a) providing a sheet of material having a plurality of slits extending through the sheet of material and a bonding material disposed on at least one surface thereof;

(b) crumpling the sheet of material into a globular configuration such that the sheet of material has a plurality of random folds, a plurality of random engaged portions, and a plurality of voids and such that at least a portion of the engaged portions are bondably connected thereby increasing the resiliency of the folds;

(c) bondably connecting the crumpled sheet of material to the exterior surface of the article prior to disposing the article into the container;

(d) repeating steps (a)–(c) until the article is substantially surrounded by the crumpled sheets of material; and (e) disposing the article into the container.

24. The method of claim 23 wherein the step of providing the sheet of material the slits in the sheet of material are further defined as uniform and parallel.

25. The method of claim 23 wherein the step of providing the sheet of material the slits in the sheet of material are further defined as non-uniform and random.

26. The method of claim 23 wherein the step of providing the sheet of material the slits in the sheet of material are further defined as non-intersecting.

27. The method of claim 23 wherein the step of providing the sheet of material the slits in the sheet of material are further defined as intersecting.

28. The method of claim 23 wherein the step of providing the sheet of material the shape of the slits in the sheet of material is further defined as being chosen from a group of shapes consisting of circles, hexagons, ovals, ellipses, squares, rectangles, stars, fanciful, decorative, linear, non-linear or curved.

29. A package, comprising:

a container;

an article positioned in the container; and a plurality of cushioning members positioned in the container so as to support and cushion the article, each of the cushioning members formed of a flexible sheet of material having a plurality of slits extending through the sheet of material, the sheet of material being crumpled into a globular configuration such that the sheet of material has a plurality of random folds, a plurality of random engaged portions, and a plurality of voids, the sheet of material having an upper surface and a lower surface with at least one of the upper surface and the lower surface having a bonding material disposed thereon such that at least a portion of the engaged portions are bondably connected thereby increasing the resiliency of the folds.

30. The package of claim 29 wherein the slits in the sheet of material are further defined as uniform and parallel.

31. The package of claim 29 wherein the slits in the sheet of material are further defined as non-uniform and random.

32. The package of claim 29 wherein the slits in the sheet of material are further defined as non-intersecting.

33. The package of claim 29 wherein the slits in the sheet of material are further defined as intersecting.

34. The package of claim 29 wherein the shape of the slits in the sheet of material is further defined as being chosen from a group of shapes consisting of circles, hexagons, ovals, ellipses, squares, rectangles, stars, fanciful, decorative, linear, non-linear or curved.

35. A package, comprising:

a container;

an article positioned in the container; and a plurality of cushioning members positioned in the container so as to support and cushion the article, each of the cushioning members formed of a flexible sheet of material having a plurality of slits extending through the sheet of material crumpled such that the sheet of material has a plurality of random folds, a plurality of random engaged portions, and a plurality of voids, the sheet of material having an upper surface and a lower surface with at least one of the upper surface and the lower surface having a bonding material disposed thereon such that at least a portion of the engaged portions are bondably connected thereby increasing the resiliency of the folds.

36. The package of claim 35 wherein the bonding material is disposed on the upper surface of the sheet of material in the form of a plurality of spaced apart strips.

37. The package of claim 35 wherein the bonding material is disposed on the upper surface of the sheet of material in the form of a plurality of spaced apart strips, and wherein the bonding material is disposed on the lower surface of the sheet of material in the form of a plurality of spaced apart strips which are in staggered, parallel relationship relative to the strips of bonding material on the upper surface of the sheet of material.

38. The package of claim 35 wherein the bonding material is disposed on substantially the entire upper surface of the sheet of material.

39. The package of claim 35 wherein the bonding material is disposed on substantially the entire upper surface of the sheet of material, and wherein the bonding material is disposed on substantially the entire lower surface of the sheet of material.

40. The package of claim 35 wherein the bonding material is a pressure sensitive adhesive.

41. The package of claim 35 wherein the bonding material is a cohesive.

42. The package of claim 35 wherein the slits in the sheet of material are further defined as uniform and parallel.

43. The package of claim 35 wherein the slits in the sheet of material are further defined as non-uniform and random.

44. The package of claim 35 wherein the slits in the sheet of material are further defined as non-intersecting.

45. The package of claim 35 wherein the slits in the sheet of material are further defined as intersecting.

46. The package of claim 35 wherein the shape of the slits in the sheet of material is further defined as being chosen from a group of shapes consisting of circles, hexagons, ovals, ellipses, squares, rectangles, stars, fanciful, decorative, linear, non-linear or curved.

47. A method of packaging an article, comprising the steps of:

(a) positioning the article in a container;

(b) providing a sheet of material having a plurality of slits extending through the sheet of material and having a bonding material disposed on at least one surface thereof;

(c) crumpling the sheet of material into a substantially globular configuration such that the sheet of material has a plurality of random folds, a plurality of random engaged portions, and a plurality of voids and such that at least a portion of the engaged portions are bondably connected thereby increasing the resiliency of the folds;

(d) disposing the crumpled sheet of material into the container about the article; and (e) repeat steps (b)–(d) until the article is substantially surrounded by the crumpled sheets of material to provide a protective cushion about the article.

48. The method of claim 47 wherein the step of providing the sheet of material the slits in the sheet of material are further defined as uniform and parallel.

49. The method of claim 47 wherein the step of providing the sheet of material the slits in the sheet of material are further defined as non-uniform and random.

50. The method of claim 47 wherein the step of providing the sheet of material the slits in the sheet of material are further defined as non-intersecting.

51. The method of claim 47 wherein the step of providing the sheet of material the slits in the sheet of material are further defined as intersecting.

52. The method of claim 47 wherein the step of providing the sheet of material the shape of the slits in the sheet of material are further defined as being chosen from a group of shapes consisting of circles, hexagons, ovals, ellipses, squares, rectangles, stars, fanciful, decorative, linear, non-linear or curved.

53. A method of packaging an article, comprising the steps of:

(a) positioning the article in a container;

(b) removing a sheet of material from a pad of a plurality of sheets of material, each sheet of material of the pad of sheets of material having a plurality of slits extending through the sheet of material and having a bonding material disposed on at least one surface thereof;

(c) crumpling the removed sheet of material into a substantially globular configuration such that the removed sheet of material has a plurality of random folds, a plurality of random engaged portions, and a plurality of voids and such that at least a portion of the engaged portions are bondably connected thereby increasing the resiliency of the folds;

(d) disposing the crumpled sheet of material into the container about the article; and (e) repeat steps (b)–(d) until the article is substantially surrounded by the crumpled sheets of material to provide a protective cushion about the article.

54. The method of claim 53 wherein the step of providing the sheet of material the slits in the sheet of material are further defined as uniform and parallel.

55. The method of claim 53 wherein the step of providing the sheet of material the slits in the sheet of material are further defined as non-uniform and random.

56. The method of claim 53 wherein the step of providing the sheet of material the slits in the sheet of material are further defined as non-intersecting.

57. The method of claim 53 wherein the step of providing the sheet of material the slits in the sheet of material are further defined as intersecting.

58. The method of claim 53 wherein the step of providing the sheet of material the shape of the slits in the sheet of material are further defined as being chosen from a group of shapes consisting of circles, hexagons, ovals, ellipses, squares, rectangles, stars, fanciful, decorative, linear, non-linear or curved.

59. A method of packaging an article, comprising the steps of:

(a) positioning the article in a container;

(b) providing a sheet of material having a plurality of slits extending through the sheet of material and having a bonding material disposed on at least one surface thereof;

(c) crumpling the sheet of material such that the sheet of material has a plurality of random folds, a plurality of random engaged portions, and a plurality of voids and such that at least a portion of the engaged portions are bondably connected thereby increasing the resiliency of the folds;

(d) disposing the crumpled sheet of material into the container about the article; and (e) repeat steps (b)–(d) until the article is substantially surrounded by the crumpled sheets of material to provide a protective cushion about the article.

60. The method of claim 59 wherein the step of providing the sheet of material the slits in the sheet of material are further defined as uniform and parallel.

61. The method of claim 59 wherein the step of providing the sheet of material the slits in the sheet of material are further defined as non-uniform and random.

62. The method of claim 59 wherein the step of providing the sheet of material the slits in the sheet of material are further defined as non-intersecting.

63. The method of claim 59 wherein the step of providing the sheet of material the slits in the sheet of material are further defined as intersecting.

64. The method of claim 59 wherein the step of providing the sheet of material the shape of the slits in the sheet of material are further defined as being chosen from a group of shapes consisting of circles, hexagons, ovals, ellipses, squares, rectangles, stars, fanciful, decorative, linear, non-linear or curved.

* * * * *